United States Patent [19]

Shank et al.

[11] 4,384,833

[45] May 24, 1983

[54] ROTARY MACHINE OF CANTED VANE TYPE HAVING CENTERING BALL

[75] Inventors: Wayne C. Shank, Tucson, Ariz.; Thomas C. Edwards, Cocoa Beach, Fla.

[73] Assignee: The Rovac Corporation, Rockledge, Fla.

[21] Appl. No.: 116,155

[22] Filed: Jan. 28, 1980

[51] Int. Cl.[3] ..... F01C 1/00; F01C 11/00; F04C 18/00; F04C 23/00

[52] U.S. Cl. ..... 418/218; 418/219; 418/255

[58] Field of Search ..... 418/195, 218, 219, 254, 418/255, 228, 229

[56] References Cited

U.S. PATENT DOCUMENTS

| | | | |
|---|---|---|---|
| 173,030 | 2/1876 | Lucas | 418/218 |
| 1,940,384 | 12/1933 | Zoller | 418/254 |
| 2,475,096 | 7/1949 | Holl | 418/219 |

FOREIGN PATENT DOCUMENTS

| | | | |
|---|---|---|---|
| 469008 | 7/1937 | United Kingdom | 418/218 |

*Primary Examiner*—John J. Vrablik

*Attorney, Agent, or Firm*—Leydig, Voit, Osann, Mayer & Holt, Ltd.

[57] ABSTRACT

A rotary machine having a cavity in the form of a doubly truncated sphere having a rotor of hollow construction mounted therein, the cavity being symmetric about a vane axis which is canted with respect to the rotor axis. The rotor includes an integral Saturn-like ring extending symmetrically about its axis dividing the cavity into first and second sides each of annular wedge shape having thick and thin portions arranged in complementary fashion. The rotor has four radial slots aligned with the shaft axis to divide the rotor into 90 degree sectors, the slots being occupied by first and second blades with each blade defining a pair of vanes which separate the sides of the cavity into successive chambers which vary cyclically in volume as the shaft rotates. A relatively thin auxiliary shaft extends axially through the hollow of the rotor. An auxiliary centering ball is telescoped over the auxiliary shaft at the point of intersection of the axes. For engaging the ball the blades have at their centers respective C-shaped recesses facing mutually inwardly in overlapping relation, each recess being radially dimensioned to snugly embrace the ball in the longitudinal dimension thereby to keep the blades centered in positions of equalized radial clearance with respect to the wall of the cavity. In the preferred embodiment the recesses are so formed that the ball is held relatively captive in the plane of each blade so that each blade is positioned in the endwise direction by the companion blade.

15 Claims, 13 Drawing Figures

Fig. 1.
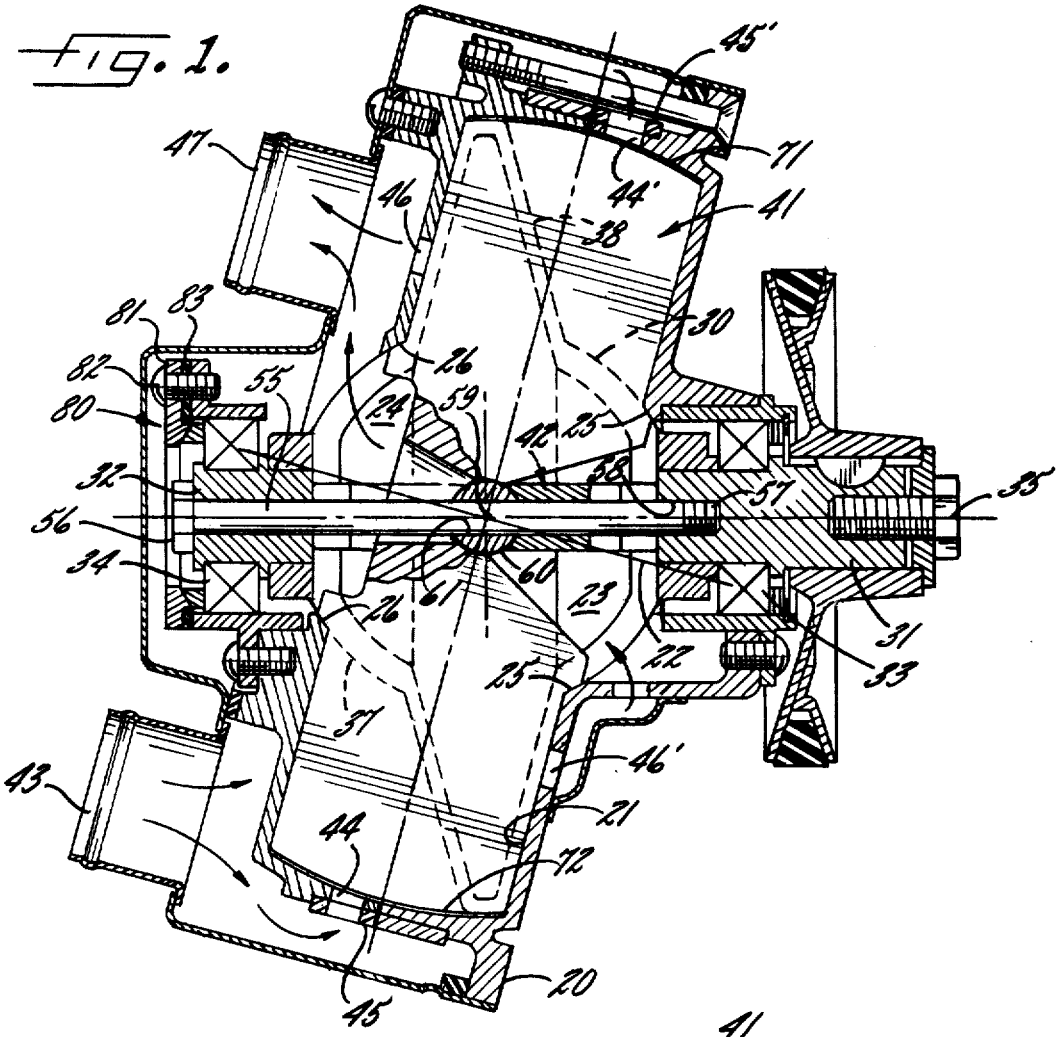
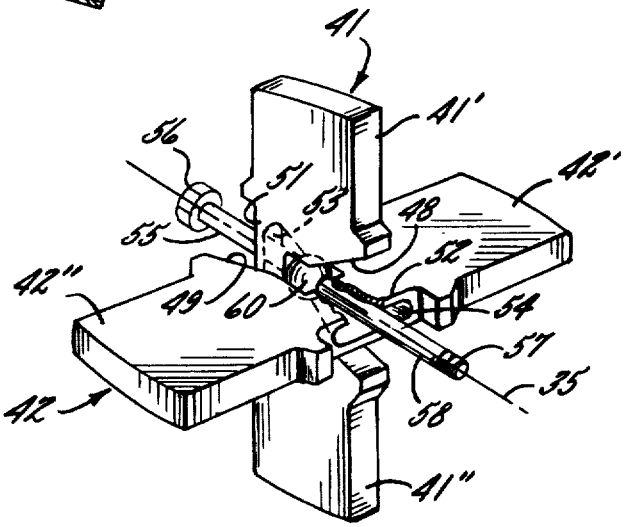
Fig. 2.

ROTARY MACHINE OF CANTED VANE TYPE HAVING CENTERING BALL

In compressors and expanders of the canted vane type it is conventional to provide a rotor in the form of a solid spherical hub mounted on the drive shaft of the machine for mounting the dividing disc (or "Saturn" ring) and for sealing the inner edges of the vanes while accommodating the cyclical rocking movement of the vanes with respect to the rotor as the shaft rotates.

A typical prior patent showing use of a spherical rotor is British Pat. No. 469,008 which was issued to Coleman July 16, 1937. This patent shows a compressor-expander of the canted vane type having a shaft h mounting a spherical rotor g. Embedded in the spherical rotor is a separator disc i having radial slots l for accommodating pairs of vanes k4 and k5, the inner edges of which ride in respective grooves 28, 29 channeled in the surface of the sphere. The same grooves 28, 29 accommodate arcuate bridges (see 35) which connect the vanes comprising a pair together. The bridges are relieved in complementary fashion to permit crossing at acute angles as well as relative rocking movement.

Our own prior copending application Ser. No. 858,680 filed Dec. 8, 1977, now abandoned, included herein by reference, also discloses a machine of the canted vane type having a spherical rotor, the rotor being of hollow construction to facilitate vane crossover. However, both in this construction and in the other prior art, represented by the British patent, reliance is placed upon the primary spherical surfaces to maintain the vanes in their radially centered positions. This, it is found, results in lubrication problems as well as vibration and unbalance at high speeds, limiting use of the device to relatively low speed applications.

It is an object of the present invention to provide, in a machine of the above type, means for constantly maintaining running clearance precisely equalized at the two ends of a blade so that the blade is kept out of surface to surface contact with the wall of the chamber and so that the blade operates under a constant condition of dynamic balance with the result that the machine may be operated at speeds of up to an order of magnitude greater than the speed of conventional machines of this type. It is, more specifically, an object of the present invention to provide an auxiliary centering ball which is jointly engaged by a pair of blades arranged at 90 degrees to one another thereby to determine the running position of the blades, each blade being kept precisely centered as it rotates so that balanced smooth-running operation is achieved up to speeds normally attained by a free running turbine rotor. It is a general object of the present invention to greatly multiply the through-put of a canted vane compressor or expander enabling a sharp reduction in size for a given capability when used for supercharging, air conditioning and other purposes.

It is a more specific object to provide in a machine of the above type an auxiliary centering ball which is free of any centering effect upon the rotor and which centeringly engages a pair of blades arranged at 90 degrees to one another. In one of the important aspects of the invention the ball is held captive in recesses which lie in the locus of a circle centered on the blade axis and having a radius equal to the ball radius so that each blade is constantly positioned in the endwise direction by the companion blade. It is nonetheless an object to provide a hollow rotor having an auxiliary blade centering ball at its center telescoped over a thin auxiliary shaft which not only maintains the ball in an oriented axial position but which serves as an axial tie rod for reinforcement of the rotor.

It is an object of the invention in one of the aspects to provide a centering ball having a radius which exceeds the thickness of the vanes but which nonetheless can be fed into position in the hollow rotor through one of the rotor vane slots, thereby facilitating assembly.

It is one of the objects of the present invention to make possible a high speed compressor-expander of the canted vane type which may be used in the compression mode as supercharger for an automotive engine, making use of the positive displacement inherent in canted vane devices to achieve control of the supercharge function to a degree exceeding that of a supercharger of the conventional turbine type.

Other objects and advantages of the invention will become apparent upon reading the attached detailed description and upon reference to the drawings in which:

FIG. 1 is an axial cross section of a compressor-expander constructed in accordance with the present invention.

FIG. 2 is a fragmentary perspective view of a pair of blades arranged at 90 degrees embracing a centering ball between them.

Figure 3:
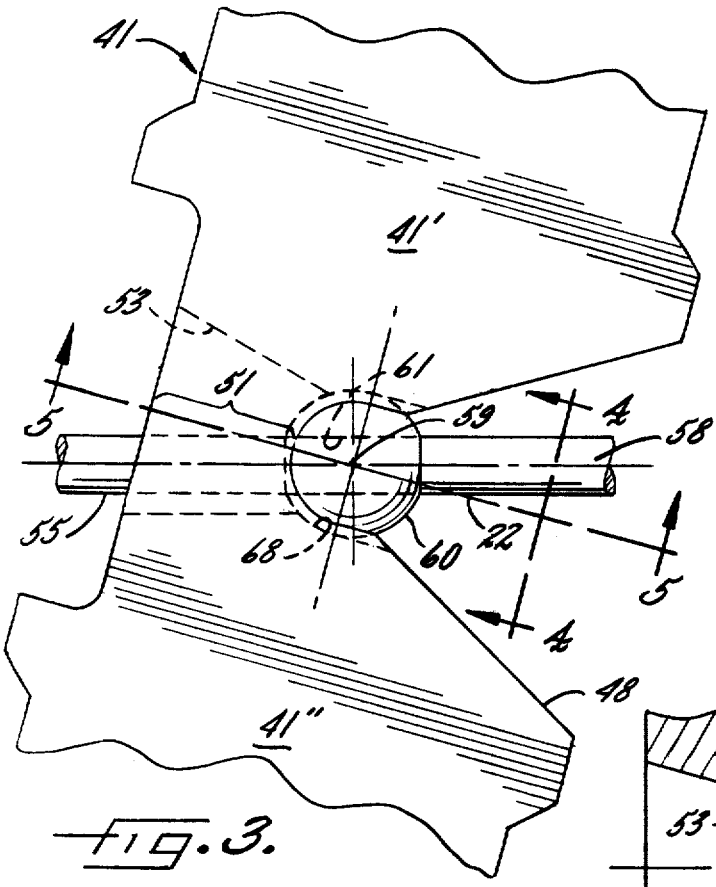
FIG. 3 is a fragmentary elevation showing the center of one of the blades embracing a centering ball mounted on an auxiliary shaft.
Figure 3A:
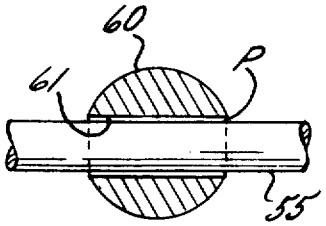

FIG. 3*a* is a fragment showing play between the auxiliary ball and auxiliary shaft.

Figure 3B:
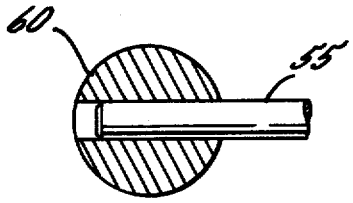

FIG. 3*b* is the same fragmentary view shown in FIG. 3*a*, but of a modified embodiment of the invention.

Figure 4:
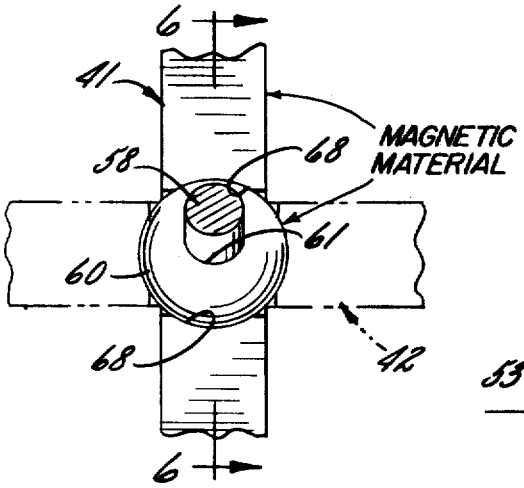

FIG. 4 is a fragmentary section looking along line 4—4 in FIG. 3.

Figure 4A:
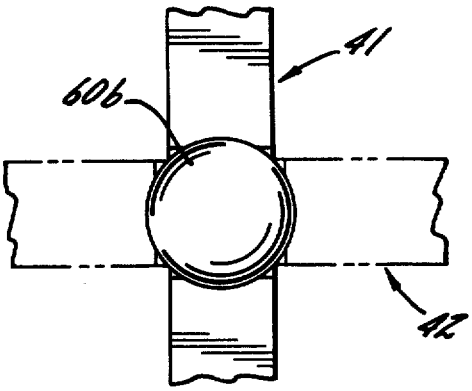

FIG. 4*a* is the same fragmentary section shown in FIG. 4, but of a modified embodiment of the invention.

Figure 5:
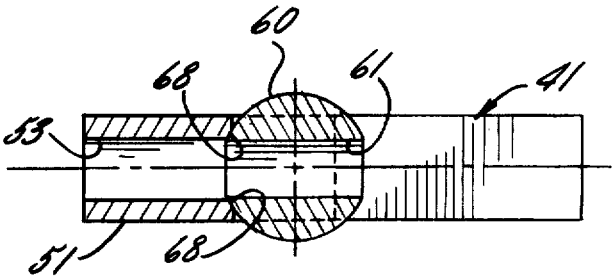

FIG. 5 is a section taken at right angles thereto looking along line 5—5 in FIG. 3.

Figure 6:
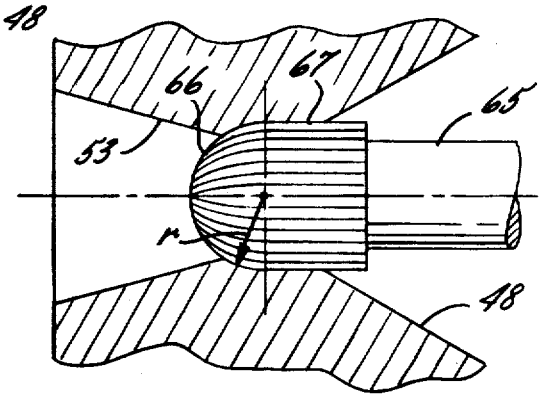

FIG. 6 is a cross sectional view looking along line 6—6 in FIG. 4 and showing the formation of a recess by means of a reaming tool capable of developing a hemispherical ball-receiving pocket.

Figure 7A:
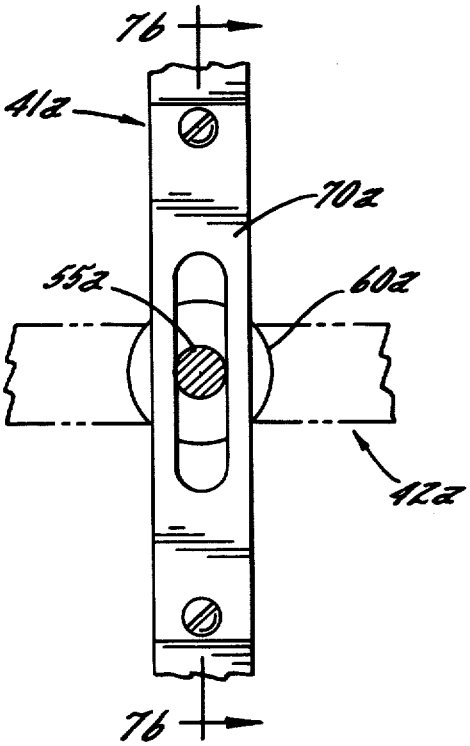
Figure 7B:
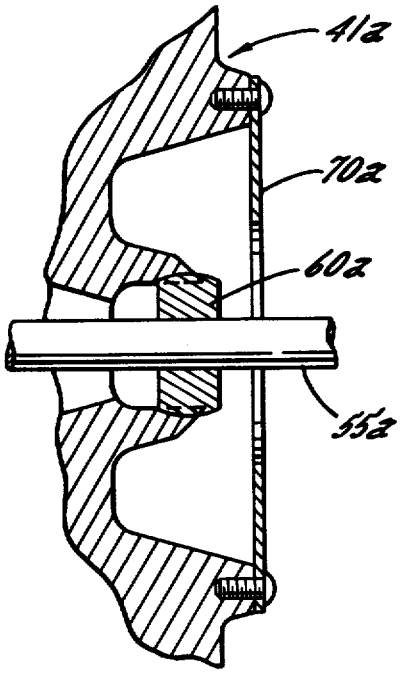
Figure 7:
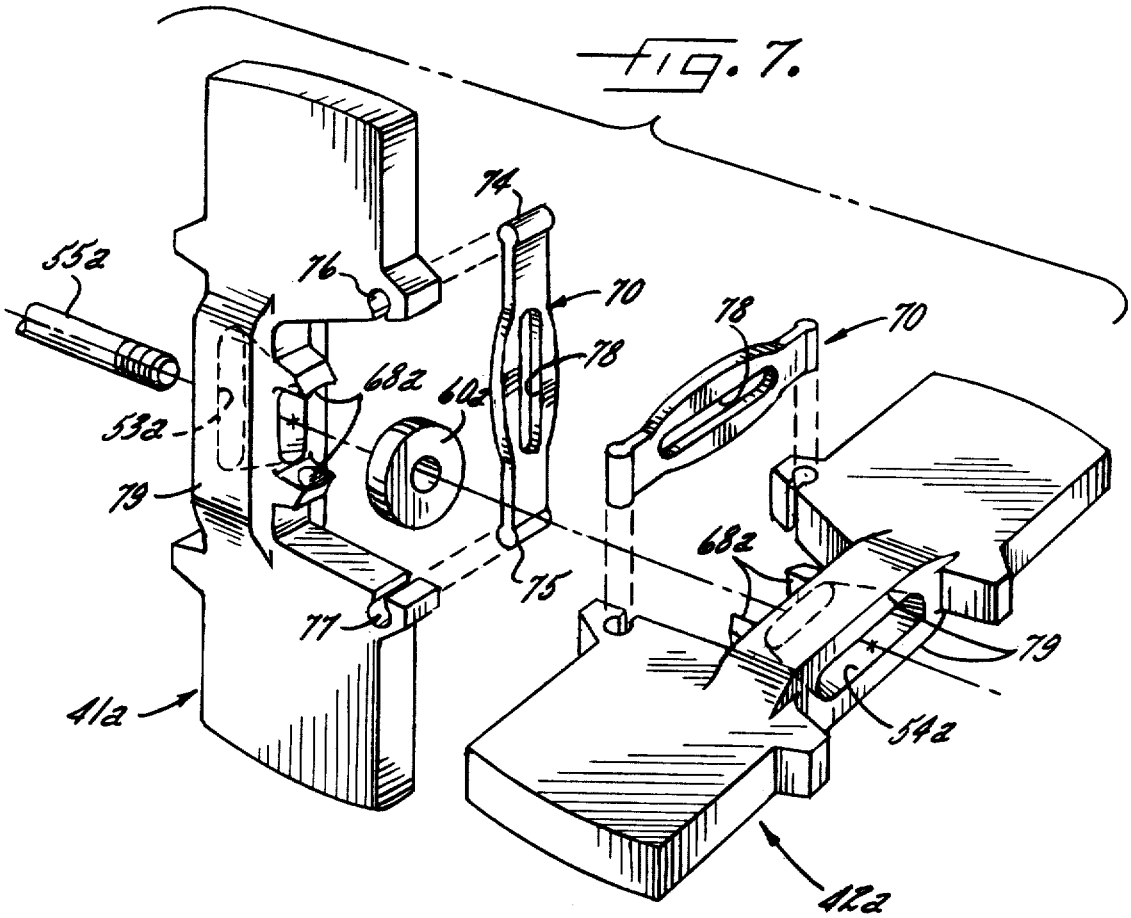

FIG. 7 is an exploded view illustrating a modified construction.

FIG. 7*a* is a side elevation of a modified version of one of the blades shown in FIG. 7.

FIG. 7*b* is an end elevation of the modified blade shown in FIG. 7*a*.

Figure 8:
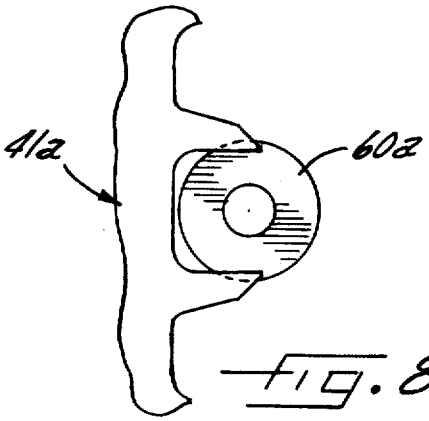

FIG. 8 is a fragment showing, in profile, the central portion of a blade with the ball element rotated for insertion.

While the invention has been described in connection with certain preferred embodiments, it will be understood that we do not intend to be limited by the particular embodiments shown but intend, on the contrary, to cover the various alternative and equivalent forms of the invention included within the spirit and scope of the appended claims.

Turning now to FIGS. 1 and 2 there is shown a compressor-expander unit having a frame or housing 20 defining a disc shaped main cavity 21 in the form of a doubly truncated sphere having an axis 22 which will be referred to for convenience as the "vane" axis. The main cavity has adjoining hub recesses 23, 24 bounded by concave spherical surfaces 25, 26 which are concentric with one another. Mounted within the main cavity and extending into the recesses is a rotor 30 having a shaft formed of complementary stub shafts 31, 32 supported in bearings 33, 34 which are aligned along a shaft axis 35.

The rotor 30 has a central spherical portion 37 which mates with the concave spherical surfaces 25, 26 and includes a Saturn-like ring 38 forming convergent conical walls and which extends symmetrically about the shaft axis. The ring, extending to the outer wall of the main cavity, divides the cavity into first and second sides each of annular wedge shape having thick and thin portions arranged in complementary fashion.

The rotor is of hollow construction and has four radially extending slots aligned with the shaft axis.

Received in the slots are two blades 41, 42 (FIG. 2) of dumbbell shape, the blade 41 forming vanes 41'-42" while the blade 42 defines vanes 42'-42". The vanes have a profile which corresponds to the profile of the truncated spherical chamber 21 with arcuate lateral edges so that each side is separated into successive chambers which vary cyclically in volume as the shaft rotates. Taking the left-hand side by way of example, and assuming that the device is to be employed as a compressor, air is taken through an inlet port 43 through inlet openings 44 controlled by a ring valve 45. It will suffice, for present purposes, to say that the ring valve is simply in the form of a circular strip capable of covering and uncovering a series of inlet openings, thereby to vary the compression ratio. The air which is progressively compressed as the rotor rotates is discharged under pressure at outlet openings 46 formed in the wall of the housing for discharge through an outlet port 47. A similar set of inlet and outlet openings is employed in the right-hand side of the machine as indicated at 44', 46'. The inlet opening 44' is connected in parallel with the opening 44, and is controlled by a valve ring 45' which may be separate from, or integral with, the ring 45, while the outlet opening 46' communicates with the hollow of the rotor for discharge of the compressed air therefrom through port 47. Pressurization of the hollow rotor has the advantage that all internal leakage within the machine results, not in loss, but simply in the recirculation, of the leaked air. While the present device is connected to form two compressors connected in parallel for employment as a supercharger or the like, other specific input and output connections may be used in either the compressor or expander mode.

In accordance with the present invention an auxiliary centering ball is provided in the hollow of the rotor and centered at the point of intersection of the vane axis with the shaft axis. The blades have at their centers respective C-shaped recesses facing mutually inwardly in overlapping relation and radially dimensioned to snugly embrace the ball thereby to keep the vanes in positions of equalized running clearance with respect to the wall of the main cavity. A thin auxiliary shaft extends axially through the rotor, the ball being bored out and telescoped over the shaft.

As shown in FIGS. 1–3 the blades 41, 42 have respective C-shaped recesses 48, 49 defining necked-down portions 51, 52 having respective, tapered and aligned slots 53, 54 which serve as clearance openings. The blades are faced mutually inwardly in overlapping relation, with the recesses and clearance openings in alignment with one another. Extending through the clearance openings is an auxiliary shaft 55 having a head 56 and threaded end 57, the threaded end having a pilot surface 58, which slightly exceeds the thread diameter.

Telescoped over the auxiliary shaft at the point of intersection 59 of the axes, is a ball 60. For accommodating the shaft the ball has a central bore 61.

In accordance with the preferred form of the present invention the recesses 48, 49, in addition to being of "C" profile are undercut in the locus of a circle centered on the blade axis and having a radius equal to the ball radius so that the ball is held relatively captive in the plane of each blade, with each blade being thereby positioned in the endwise direction by the companion blade. Such circle is indicated by the profile of the ball 60 as shown in FIG. 4. Preferably however the recesses are pocketed in spherical locus so as to provide "area" contact with the ball rather than merely point or line contact. Such spherical pocketing is preferably brought about by use of a reaming tool 65 (FIG. 6) having a hemispherical tip 66 merging into a cylindrical surface 67, the latter both being of radius r which is equal to the ball radius. The regions in spherical "area" engagement are indicated at 68 in FIGS. 4 and 5. In effect, one-half of the ball is pocketed in the spherical recess in one of the blades while the other half is pocketed in the companion blade, arranged at 90 degrees thereto. Where spherical pocketing of the ball is employed, means may be provided for biasing the blades mutually in the direction of the ball to keep them axially bottomed on one another to prevent their drifting apart upon rotation at high speed. Where the blades and ball are formed of magnetic material, (see FIG. 4) or at least where the blades have magnetic seats, the bias may be provided by permanently magnetizing the ball, seats, or both.

While the undercut area in engagement with the surface of the ball is, in both of the above versions of the invention, quite limited, it will be understood that the ball, its shaft and the rotor blades all rotate in unison with one another so that the only relative motion is a slight relative rocking action (skew) which occurs cyclically with the shaft rotation. Moreover, with the blades 41, 42 in balanced and centered condition, the centrifugal forces generated therein balance out so that any net radial force exerted upon the ball is extremely low, thereby reducing bearing pressures between the ball and the blades to a negligible level, even at "turbine" speeds on the order of 10–20,000 rpm.

As a result of using the centering ball the radial running clearances, indicated in FIG. 1 at 71, 72, remain balanced and equalized so that rubbing contact between the vane and the wall of the chamber is obviated. The running clearance has, for purposes of illustration, been exaggerated and will normally be on the order of only a few thousandths of an inch. Indeed, using the centering ball of the present invention the degree of running clearance against the shoulders of the blades at regions 25, 26 may also be increased so that these regions, while providing an adequate pneumatic seal, are not in actual rubbing contact.

The net result is that each blade, rather than being guided by the peripheral surfaces which it engages, instead is centrally captive on the ball so that tip speed is no longer a severe limitation, which explains why the device, while of the positive displacement type, may be operated at speeds normally associated with turbines.

The importance of this may be appreciated by considering what tends to happen in absence of a centering ball: A blade may be theoretically balanced and theoretically intended to operate so that clearances at 71, 72 are respectively equal in amount. However, as soon as rotation takes place, and assuming a certain amount of running clearance at the shoulders 25, 26, the blade will tend to shift endwise, taking up the running clearance at one end and doubling it at the other. This results in three disadvantages. In the first place the end of the blade where the running clearance has been taken up will scuff against the wall of the cavity, producing wear, particularly at high speeds. If the engaged surface is lubricated, the lubrication itself will produce a viscous drag. Secondly, the device will begin to leak in the region, at the opposite end of the blade, where the running clearance has been doubled. Thirdly the radial shift will throw the blade out of balance, causing vibration and greatly shortening the life of the bearings. Add to this the tendency for the blades at high speed to vibrate endwise between the limits of movement. All of these problems are avoided by the centering effect of the ball.

In the lack of circular or cylindrical, undercut close tolerances must be adhered to to insure concentricity between the auxiliary shaft 55 and the stubshafts. The pilot at 58 adjacent the threaded tip of the auxiliary shaft provides a close, centered fit with respect to the stubshaft 31. However, when practicing the invention in its preferred form, by using the tool of FIG. 6, so that the ball is held relatively captive in the plane of each blade, it is not necessary to center the auxiliary shaft 55 precisely, by going to the length of providing an accurate pilot surface 58. Instead, bore 61 of the ball 60 may be made oversized to provide intentional play, indicated at P in FIG. *3a*, so that the interaction of the blades, one upon the other, provides accurate radial centering, so that the shaft 55 is free of any endwise positioning effect upon the blades. Even though the auxiliary shaft 55 may not be employed for centering purposes, it does provide the valuable "tie rod" function, axially interconnecting the stubshafts 31, 32 thereby to reinforce the hollow rotor.

Because of the C-shaped profile of the blades and the centrifugal force to which they are subjected at high speed, there may be a tendency for the "C" to open slightly, resulting in a change in running clearance as the speed is increased, depending in part upon the stiffness of the material employed for the blade. Accordingly, it is contemplated that the C-shaped recess in the blade be structurally bridged by a reinforcing connector having a central slot for clearing the auxiliary shaft 55. Such a construction has been illustrated, in exploded form, in FIG. 7, where similar parts are indicated by the same reference numeral with addition of subscript "a". In carrying out the invention each blade is equipped with a reinforcing connector 70 of "dog bone" shape having enlarged ends 74, 75 designed to fit into mating recesses 76, 77 broached or otherwise formed in the inner edges of the blade. A central opening 78 provides shaft clearance for all of the relative positions of the associated blade.

According to one of the aspects of the present invention the ball 60, 60*a* need not be complete but may, and preferably is, symmetrically truncated to produce flat parallel side surfaces defining a ball axis (see FIG. 7). The auxiliary shaft 55*a* then serves to keep the truncated ball oriented in a position in which the ball axis is substantially parallel to the shaft axis for proper seating of the ball on the spherical pocket surfaces 68*a*.

Since the shaft 55 serves purposes other than to support the ball or to keep it oriented, such shaft, serving as a tie rod, will normally be included in the inventive combination. Other means may, however, be substituted for maintaining a truncated ball in oriented position. For example the shaft 55 need not extend all the way across the rotor but need only be extended to a position within the ball, as illustrated in FIG. *3b*. Where this is done, the play P referred to in connection with FIG. *3a* is not necessary, and the shaft 55 may be made sufficiently thin as to flex freely, with reliance being placed upon the blades alone to provide mutual centering effect.

In accordance with one of the aspects of the present invention a truncated ball is provided in which the diameter of the ball exceeds the thickness of the blades to insure that the blades, in gripping the ball, will not interfere with one another in all of their relative positions, but the axial thickness of the ball is such as not to exceed the thickness of the blades thereby to enable the ball to be inserted into working position through a slot in the rotor.

Thus referring to FIG. 7, the blade enlargements shown at 79, and the corresponding enlargement of the reinforcing connector 70 may, if desired, be omitted, and the blade may be made of uniform flat construction similar to that of the previous embodiment and with the reinforcing connector 70*a* in the form of a strap secured by axially facing screws and conformingly dimensioned. Such a modified construction is illustrated in FIGS. *7a* and *7b*. This enables the blades 41*a*, 42*a*, together with the ball 60*a*, to be inserted into the working positions in a preassembled rotor. To do this, the truncated ball 60*a* is swung through an angle of 90 degrees with respect to the blade 41*a*, as illustrated in FIG. 8, so that the axis of the ball is parallel to the thickness dimension of the blade. The second blade 42*a* is then inserted into position in its receiving slots. Following this the ball 60*a* is rotated back into its normal coaxial position in which it is seated in the recesses of both of the blades. The auxiliary shaft 55*a*, in the form of a bolt, is next inserted into axial position and screwed tight.

For the purpose of axially adjusting the rotor position, the bearing 34 which supports the stubshaft 32 at the left-hand side of the rotor may be axially shiftable to a small degree. Referring to FIG. 1 the bearing may be provided with an adjustable mount generally indicated at 80 made up of a mounting ring 81 having a plurality of peripherally distributed screws 82 (only one being shown) for variably compressing an elastomeric ring 83. It will be apparent that by tightening the screws 82, assuming lack of axial play in the bearings, the rotor is shifted slightly to the right into a desired running condition. The axial position of the blades 41, 42 is, however, independent of rotor position by reason of the fact that the ball is slidable on the shaft.

With regard to the materials of construction, it will be convenient to make the housing in two facing sections of metal cast and thereafter machined. The hollow rotor is also preferably made of metal formed in two parts separated along a transaxial plane, welded and thereafter machined. However, it is contemplated that the vanes themselves may be made of either metal or plastic, either solid or of cored-out construction, with the choice material preferably being such as to provide light weight combined with an inherently low coefficient of friction with respect to the engaged rotor surfaces. As stated earlier, the radially extending surfaces of the vanes are not in direct rubbing contact. While the flat side surfaces of the vanes are in engagement with the walls of the rotor slots, the relative motion in the area of engagement is a rocking action taking place over a short arc, the average speed is low and lubrication does not create any serious problem.

The term "compressor-expander" as used herein refers to the fact that the device may be employed either for compressing or expanding air or other gas, with the two halves being connected together normally in parallel or, if desired, in series to act as either a pump or a motor. The term also includes use of one side as a compressor and use of the other as an expander, for example, in its use as an air conditioner, as discussed in some detail in the above-mentioned copending application. The term "C-shaped recess" used herein refers to opposed interconnected surfaces for embracing the ball regardless of whether a reinforcing connector 70 is used. The term "compressor-expander" is not to be limited to a device performing both of these functions but is intended to cover a device capable of performing either or both functions.

It will be apparent that the objects of the invention have been amply fulfilled, primarily to produce a pneumatic pump or motor which is of the positive displacement type but which can be operated at the elevated speeds normally achieved only in turbines. Of course the centering advantages of the ball also may be utilized to provide smoother operation when the machine is operated at lower more conventional speeds.

In the preferred form of the invention described above, two blades, forming a total of four vanes, arranged perpendicularly to one another, snugly and simultaneously embrace the ball in regions angularly spaced at right angles so that each blade keeps the other blade in a radially centered position. However, it will be understood by one skilled in the art that the invention in its broader aspects is not limited to use of two blades, and ball centering may, if desired, be applied to a three-bladed construction, for example, that shown in our own prior co-pending application Ser. No. 858,680 referred to. Where three blades are used adequate central access for the C-shaped gripping portions will require use of a somewhat larger ball as, for example, the truncated ball illustrated in FIGS. 7 and 8.

The preferred form of the invention described above employs a slender auxiliary shaft, or bolt, 55 for the dual purpose of reinforcing the rotor and for maintaining the ball centered, or at the least, oriented. Where rotor reinforcement is not considered to be necessary, and where a truncated ball is not employed, the invention contemplates, in one of its aspects, illustrated in FIG. 4*a* the use of a ball 60*b* free of any central bore, a ball which has an unmodified, complete and intact surface, with one of the blades 41 serving to hold the ball centered and captive in one direction while the other blade holds the ball centered and captive in a direction at right angles thereto. Free of any bore or other constraint, the ball is therefore free to turn randomly in all directions during operation to present to the blades a constantly renewable wear surface.

What we claim is:

1. A rotary machine comprising, in combination, a housing, the housing defining a disc-shaped main cavity having adjoining hub recesses, shaft bearings in the housing, the main cavity being in the form of a doubly truncated sphere symmetrical about a vane axis which is canted with respect to the shaft axis and the axial recesses thereof being defined by concave concentrically opposed spherical surfaces, a rotor in the housing having axially projecting stub shaft means received in the bearings, the rotor having a central spherical portion formed to mate with the concave spherical surfaces, the rotor further including an integral Saturn-like ring centered about the shaft axis and extending symmetrically to the outer wall of the main cavity dividing the cavity into first and second sides each of annular wedge shape having thick and thin portions arranged in complementary fashion, the rotor being of hollow construction and having diametrically extending slots aligned with the shaft axis to divide the rotor into equal sectors, blades fitted in the respective slots, each blade forming a pair of vanes having a profile substantially corresponding to the profile of the main cavity to separate each side into successive chambers which vary cyclically in volume as the shaft rotates, the first and second sides each having inlet and outlet ports, an auxiliary ball inside the rotor substantially centered at the point of intersection of the vane axis with the shaft axis, said auxiliary ball being free for at least limited movement relative to the rotor, each blade captively engaging the ball against endwise movement in the plane of the blade so that each blade acts to keep each other blade in a radially centered position.

2. A rotary machine comprising, in combination, a housing, the housing defining a disc-shaped main cavity having adjoining hub recesses, aligned shaft bearings in the respective recesses, the main cavity being in the form of a doubly truncated sphere symmetric about a vane axis which is canted with respect to the shaft axis and the axial recesses thereof being defined by concave concentrically opposed spherical surfaces, a rotor in the housing having axially projecting stub shafts received in the bearings and having a central spherical portion formed to mate with the concave spherical surfaces, the rotor including an integral Saturn-like ring extending about the shaft axis, the ring extending symmetrically to the outer wall of the main cavity dividing the cavity into first and second sides each of annular wedge shape having thick and thin portions arranged in complementary fashion, the rotor being of hollow construction and having diametrically extending slots aligned with the shaft axis to divide the rotor into equal sectors, blades fitted in the respective slots, each blade forming a pair of vanes having a profile substantially corresponding to the profile of the main cavity to separate each side into successive chambers which vary cyclically in volume as the shaft rotates, the first and second sides each having inlet and outlet ports, an auxiliary ball inside the rotor substantially centered at the point of intersection of the vane axis with the shaft axis, said auxiliary ball being free for at least limited movement relative to the rotor, the blades having at their centers respective C-shaped recesses facing mutually inwardly in overlapping relation and radially dimensioned to snugly and simultaneously embrace the ball thereby to keep the vanes in positions of equalized radial clearance with respect to the wall of the main cavity.

3. The combination as claimed in claim 2 in which each C-shaped recess is in the locus of a cylinder centered on the blade axis and having a radius equal to the ball radius.

4. The combination as claimed in claim 2 in which the C-shaped recess is in the locus of a circle centered on the blade axis and having a radius equal to the ball radius so that the ball is held relatively captive in the plane of each blade with each blade being thereby positioned in the endwise direction by the companion blade, the rotor having axially extending through its center a thin auxiliary shaft, the ball having a central bore and telescoped over the auxiliary shaft, the ball having radial play on the shaft so that the shaft is free of any endwise positioning effect upon the blades.

5. The combination as claimed in claim 2 in which the rotor has axially extending through its center a thin auxiliary shaft in the form of a removable bolt concentric with the stubshafts and interconnecting the same to serve as a tie rod between them for reinforcement of the hollow rotor, each blade having a reinforcing connector for structurally bridging the C-shaped recess therein, the ball having a central bore and telescoped over the auxiliary shaft, each blade and its connector having alined slots forming respective clearance openings for the auxiliary shaft to permit relative rocking movement of the blades as the rotor rotates.

6. The combination as claimed in claim 2 in which each C-shaped recess is in the form of a hemispherical axially-facing pocket having a radius equal to the ball radius, the surfaces of the pockets being axially and radially seated on the ball.

7. The combination as claimed in claim 6 in which means are provided for biasing the blades mutually in the direction of the ball to keep them axially bottomed thereon.

8. The combination as claimed in claim 6 in which the ball has a complete and intact surface and is thereby free to turn randomly in all directions during operation to present to the blades a constantly renewable wear surface.

9. The combination as claimed in claim 2 in which the rotor has axially extending through its center a thin auxiliary shaft, the ball having a central bore and telescoped over the auxiliary shaft.

10. The combination as claimed in claim 9 in which the auxiliary shaft is in the form of a bolt aligned with and interconnecting the stubshafts thereby providing axial reinforcement to the rotor.

11. The combination as claimed in claim 9 in which means are provided for axially positioning the rotor with respect to the housing accompanied by endwise movement of the auxiliary shaft and in which the ball is sufficiently free on the shaft as to accommodatingly and constantly restore the blades to a laterally centered condition within the housing as the rotor and blades revolve.

12. The combination as claimed in claim 2 in which the ball is symmetrically truncated to produce flat parallel side surfaces defining a ball axis, and means for engaging the ball while the rotor is turning to maintain the ball axis substantially parallel to the shaft axis.

13. The combination as claimed in claim 12 in which the diameter of the ball exceeds the thickness of the blades and in which the axial thickness of the ball does not exceed the thickness of the blades thereby enabling the ball to be inserted into position through a slot in the rotor.

14. A rotary machine comprising, in combination, a housing, the housing defining a disc-shaped main cavity having adjoining hub recesses, aligned shaft bearings in the respective recesses, the main cavity being in the form of a doubly truncated sphere symmetric about a vane axis which is canted with respect to the shaft axis and the axial recesses thereof being defined by concave concentrically opposed spherical surfaces, a rotor in the housing having axially projecting stub shafts received in the bearings and having a central spherical portion formed to mate with the concave spherical surfaces, the rotor including an integral Saturn-like ring extending about the shaft axis, the ring extending symmetrically to the outer wall of the main cavity dividing the cavity into first and second sides each of annular wedge shape having thick and thin portions arranged in complementary fashion, the rotor being of hollow construction and having diametrically extending slots aligned with the shaft axis to divide the rotor into four 90 degree sectors, first and second blades extending perpendicularly to one another in the slots, each blade forming a pair of vanes having a profile substantially corresponding to the profile of the main cavity to separate each side into successive chambers which vary cyclically in volume as the shaft rotates, the first and second sides each having inlet and output ports, an auxiliary ball inside the rotor substantially centered at the point of intersection of the vane axis with the shaft axis, said auxiliary ball being free for at least limited movement relative to the rotor, the blades having at their centers respective C-shaped recesses facing mutually inwardly in overlapping relation and radially dimensioned to snugly and simultaneously embrace the ball in regions angularly spaced at right angles so that each blade keeps the other blade in a radially centered position.

15. A rotary machine comprising, in combination, a housing, the housing defining a disc-shaped main cavity having adjoining hub recesses, shaft bearings in the housing, the main cavity being in the form of a doubly truncated sphere symmetrical about a vane axis which is canted with respect to the shaft axis and the axial recesses thereof being defined by concave concentrically opposed spherical surfaces, a rotor in the housing having axially projecting stubshaft means received in the bearings, the rotor having a central spherical portion formed to mate with the concave spherical surfaces, the rotor further including an integral Saturn-like ring centered on the shaft axis and extending symmetrically to the outer wall of the main cavity dividing the cavity into first and second sides each of annular wedge shape having thick and thin portions arranged in complementary fashion, the rotor being of hollow construction and having diametrically extending slots aligned with the shaft axis to divide the rotor into four 90 degree sectors, first and second blades extending perpendicularly to one another in the slots, each blade forming a pair of vanes having a profile substantially corresponding to the profile of the main cavity to separate each side into successive chambers which vary cyclically in volume as the shaft rotates, the first and second sides each having inlet and outlet ports, an auxiliary ball inside the rotor substantially centered at the point of intersection of the vane axis with the shaft axis, said auxiliary ball being free for at least limited movement relative to the rotor, means mounting the ball on said first blade, the second blade having means for diametrically engaging the ball in regions lying generally perpendicular to the first blade so that each blade keeps the other blade in a radially centered position.

* * * * *